US007237783B2

(12) United States Patent
Kieffer et al.

(10) Patent No.: US 7,237,783 B2
(45) Date of Patent: Jul. 3, 2007

(54) ACCESSORY CART FOR STRIPING PAVEMENT AND OTHER SURFACES

(75) Inventors: Joseph Kieffer, Sparta, NJ (US); Norman Alvin Cyphers, Lafayette, NJ (US); Michael Dosch, Lake Hiawatha, NJ (US)

(73) Assignee: Titan Tool, Inc., Oakland, NJ (US)

( * ) Notice: Subject to any disclaimer, the term of this patent is extended or adjusted under 35 U.S.C. 154(b) by 158 days.

(21) Appl. No.: 10/533,676

(22) PCT Filed: Jan. 9, 2004

(86) PCT No.: PCT/US2004/000489

§ 371 (c)(1),
(2), (4) Date: Apr. 28, 2005

(87) PCT Pub. No.: WO2004/065018

PCT Pub. Date: Aug. 5, 2004

(65) Prior Publication Data

US 2006/0027583 A1 Feb. 9, 2006

Related U.S. Application Data

(60) Provisional application No. 60/439,934, filed on Jan. 14, 2003.

(51) Int. Cl.
*B62B 3/02* (2006.01)

(52) U.S. Cl. ..... 280/47.34; 280/47.371; 239/150

(58) Field of Classification Search ..... 280/47.34, 280/47.11, 47.371, 47.36, 47.17, 62, 47.18, 280/47.2; 239/150, 147, 172, 754; 404/93, 404/94

See application file for complete search history.

(56) References Cited

U.S. PATENT DOCUMENTS

| | | | | |
|---|---|---|---|---|
| 2,812,211 | A | 11/1957 | Gardner | |
| 3,239,147 | A | 3/1966 | Sweet | |
| 3,352,283 | A | 11/1967 | Maus | |
| 3,540,632 | A * | 11/1970 | Clingan | 222/626 |
| 4,262,821 | A | 4/1981 | Smrt | |
| 4,828,177 | A | 5/1989 | Schuitemaker | |
| 4,877,348 | A | 10/1989 | Opie | |
| 4,893,751 | A | 1/1990 | Armstrong | |
| 4,943,008 | A | 7/1990 | Smrt | |
| 5,312,043 | A | 5/1994 | Whitney | |
| 6,805,304 | B1 | 10/2004 | Nokes et al. | |
| 6,942,735 | B2 * | 9/2005 | Rich | 118/313 |

(Continued)

OTHER PUBLICATIONS

International Search Report dated Jul. 22, 2005.
Written Opinion dated Jul. 22, 2005.

*Primary Examiner*—Jeff Restifo
(74) *Attorney, Agent, or Firm*—Faegre & Benson LLP

(57) ABSTRACT

An accessory cart having a J-shaped frame for removable mounting of a spray gun to convert a conventional airless paint sprayer into a line striper to paint lines on parking lots, curbs, warehouse floors and other pavement surfaces, and which can alternately be used in conjunction with a traditional line striper in cramped spaces or between parked cars, and which is easily converted from a 3-wheeled device to a 2-wheeled device for painting curved lines, and which permits adjustable positioning of the spray gun at a desired location on the cart to optimize the spray pattern in a particular application.

28 Claims, 10 Drawing Sheets

U.S. PATENT DOCUMENTS 7,121,484 B2 * 10/2006 Daley ..... 239/754
7,140,555 B1 * 11/2006 Bricko et al. ..... 239/124
7,150,413 B1 * 12/2006 Bricko et al. ..... 239/150
7,152,812 B1 * 12/2006 Johnson ..... 239/164

* cited by examiner

ACCESSORY CART FOR STRIPING PAVEMENT AND OTHER SURFACES

CROSS REFERENCE TO RELATED APPLICATIONS

This application is the National Stage of International Application No. PCT/US2004/000489, filed Jan. 9, 2004, which claims the benefit under 35 U.S.C. 119 (a-e) of U.S. Provisional Application 60/439,934 filed Jan. 14, 2003, which is herein incorporated by reference.

FIELD OF THE INVENTION

The present invention relates generally to the field of painting apparatus. More particularly, this invention relates to accessory devices for conventional paint sprayers in the form of an easily transportable cart on which a paint spray gun may be mounted for converting a conventional airless paint sprayer into a line striper to paint lines on parking lots, curbs, warehouse floors, and other pavement surfaces.

BACKGROUND OF THE INVENTION

Devices exist for painting lines on pavement surfaces in parking lots and other locations where the line is sprayed onto the pavement by a paint spray gun. Conventional line stripers are not without their limitations, however, especially with respect to their reduced maneuverability in tight spaces, such as between vehicles that are parked in a parking lot. In particular, conventional line stripers are too big and too awkward to be able to spray lines between parked cars, for example. Another drawback with conventional line stripers is their inappropriateness to be used indoors to stripe warehouse floors, for example, due to the fact that a line striper is typically powered by a gasoline engine.

Furthermore, not everyone can afford a line striper, especially when the need for one might only be an occasional event hardly worth the cost of owning one. And there are those occasions when the striping job is too small to justify the effort necessary to bring a conventional line striper to the job site.

In view of the prior art the need exists for a lightweight cart onto which a spray gun may be quickly and easily mounted for surface line marking.

SUMMARY OF THE INVENTION

The present invention is a line striper cart having a J-shaped frame member formed of a longitudinal section and first and second transverse sections, with a plurality of wheels mounted on the frame member. The line striper cart of the present invention also includes a spray gun holder that provides a means positionable along the frame member for attaching a spray gun to the cart; and the cart further includes a spray gun extender or pole with a remote gun-operating handle that also provides a means for moving the cart by hand.

OBJECTS OF THE INVENTION

It is therefore an object of this invention to provide a cart that can be used as an accessory device for converting an airless paint sprayer into a line striper for use on small striping jobs to paint lines on parking lots, curbs, warehouse floors and other pavement surfaces.

It is also an object of this invention to provide a paint striping cart that can be easily maneuvered in tight spaces and moved with little effort from one line to the next.

Another object yet of this invention is to provide a paint striping cart that can be converted from a 3-wheeled device to a 2-wheeled device for painting curved lines.

Still another object of this invention is to provide a paint striping cart that is adaptable for removable mounting of a spray gun virtually anywhere on the cart for different striping applications.

It is also an object of this invention to provide a paint striping cart that is adaptable for adjustable positioning of a spray gun at a desired location on the cart to optimize the spray pattern in a particular application.

An additional object of this invention is to provide a paint striping cart that is relatively simple, sturdy and inexpensive, and which is easy to assemble and use.

These and other objects and advantages of the invention will become apparent from the following description and the accompanying drawings.

DETAILED DESCRIPTION OF THE INVENTION

Figure 1:
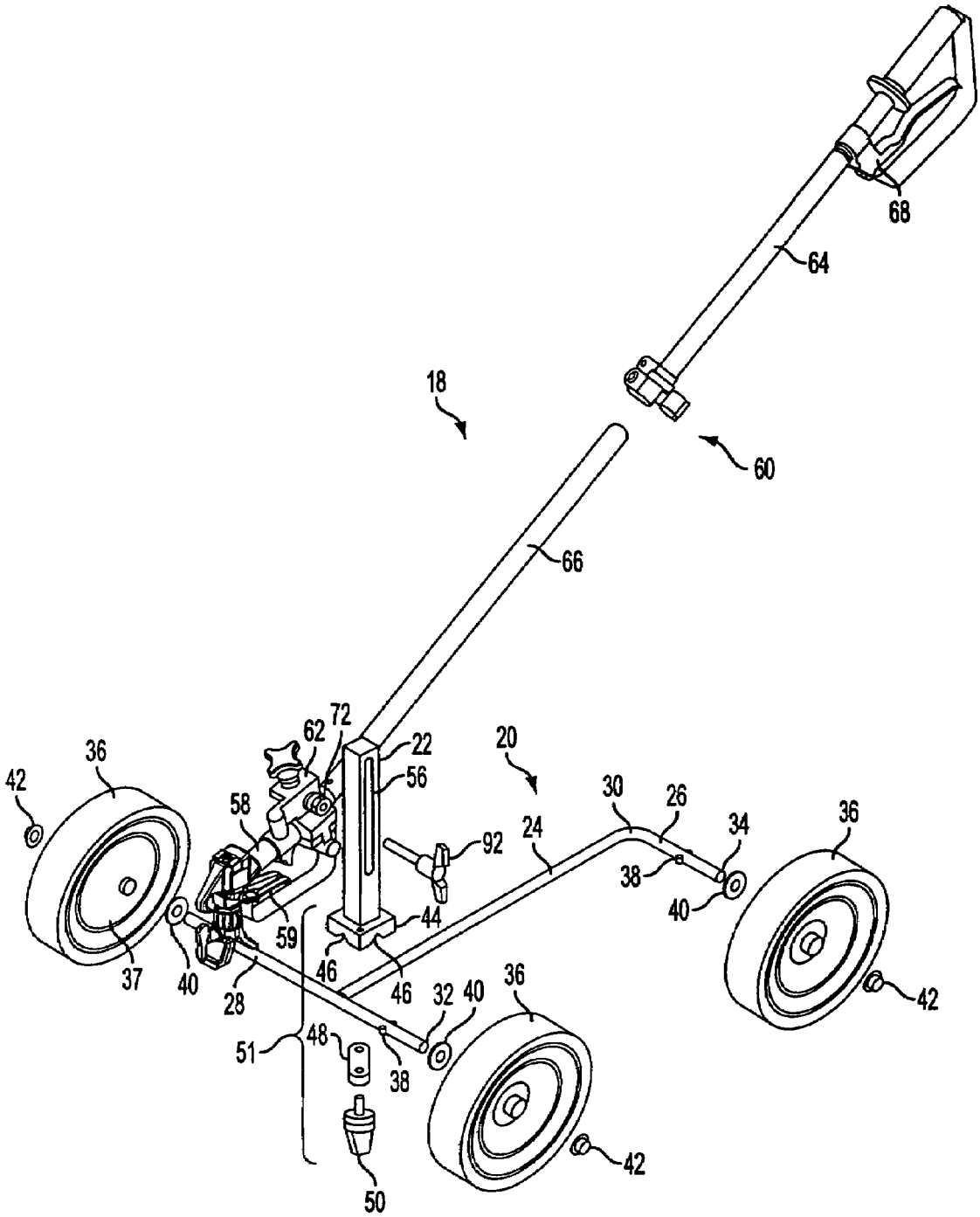
FIG. 1 is an exploded view in perspective of the present invention.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. In the various views of the drawings, like reference characters designate like or similar parts.

Referring to the figures, the present invention is directed to a cart 18 including a rigid skeletal frame member 20 providing a track-like surface on which support post 22 may be attached. The frame member 20 comprises a longitudinal section 24, a first transverse section 26 and a second transverse section 28 together providing a structure having a shape as the letter J.

Preferably, frame member 20 is formed of one half-inch cold rolled steel rod, however, any material of sufficient strength and rigidity may be used in this invention. The stock may be formed in a conventional manner by any of various methods. The stock may also take the shape of different forms, besides round cross-section, and may be solid or tubular provided the selection allows for variable positioning of the support post 22 along the frame member 20. A frame formed of round stock, either rod or tubing, is preferred because it then also may serve as an axle for each wheel. Other shapes of stock material will require additional, more costly, manufacturing steps to form the axles.

Preferably, the first transverse section 26 is formed by making a right angle bend 30 in the longitudinal section 24 at a desired distance from one end thereof. Then the second transverse section 28 is welded preferably perpendicular to the longitudinal section 24 at its other end in a manner ensuring that the entire structure lays flat. Longitudinal section 24 and second transverse section 28 are welded together at a point where end 32 of second transverse section 28 is aligned with end 34 of the first transverse section 26.

There is a pair of wheels 36 rotatably attached to the second transverse section 28 and a single wheel 36 rotatably attached to the first transverse section 26. The ends of the transverse sections are adapted to provide support axles on which the wheels 36 are mounted. Referring to FIG. 1, there is a pair of crimps 38 formed at each end of the transverse sections to provide stops for preventing inward axial movement of the wheels 36. A washer 40 may be used to serve as a bearing surface against which the hub 37 of wheel 36 slides during rotation. End caps 42 are attached to the exposed ends of the transverse sections to keep the wheels 36 from falling off.

Figure 9:
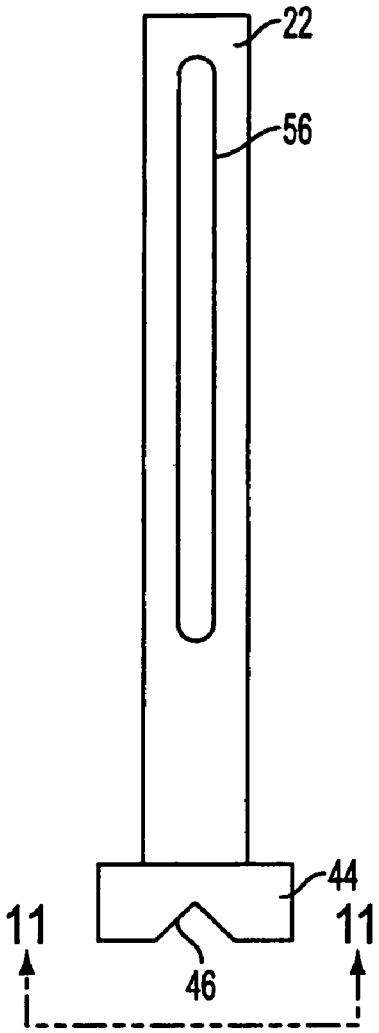
FIG. 9 is a first side elevation view of a support post useful in the practice of the present invention.
Figure 10:
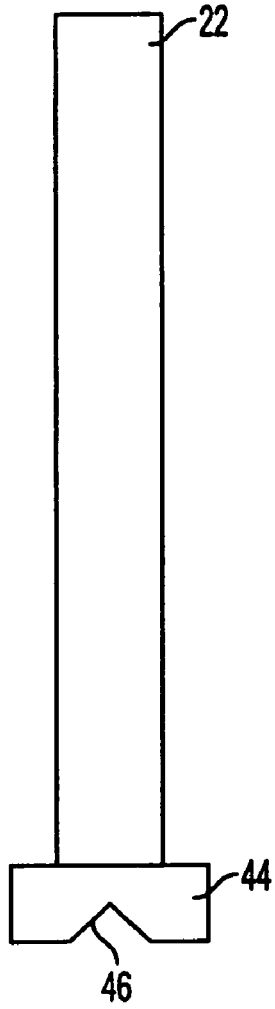
FIG. 10 is a second side elevation view of the support post of FIG. 9.
Figure 11:
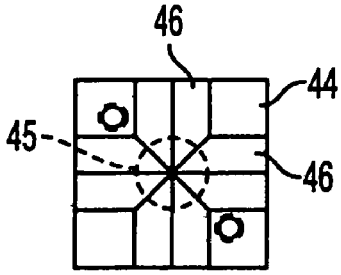
FIG. 11 is a plan view of the support post taken in the direction of arrows 11-11 of FIG. 9.

Referring now also to FIGS. 9, 10 and 11, preferably a plate or base 44 is welded to the support post 22 to provide a means for attaching the support post 22 to the frame member 20. The underside surface of plate 44 has two intersecting grooves 46 extending across the bottom of plate 44 to opposite ends of the plate to permit the support post 22 to be mounted in various locations and orientations to be described later. V-shaped grooves are preferred because of the relative ease in machining them. They also permit the support post 22 to self-align with the round stock material of frame member 20 and thus compensate for any manufacturing tolerances. In addition, making adjustments like placing the support post 22 at an angle with respect to a vertical axis in order to compensate for a special painting situation may be accomplished easily through the relative interaction between round stock material and V-shaped groove 46.

The support post 22 is removably attached to the frame member 20 with a plate 48 secured with a pair of releasable fasteners 50 (only one of which is shown). Plate 48, together with base 44 and fasteners 50 form a clamp 51. Preferably, the plate 48 extends diagonally across base 44 to increase the amount of surface contact between clamp 51 and frame member 20 for increased holding power. It will be apparent that the support post 22 may be positioned virtually anywhere on a straight portion of the frame member 20. The support post 22 may also be positioned directly over the point of attachment of longitudinal section 24 and the transverse section 28, in which case it is preferable to include an appropriately sized hole 45 (FIG. 11) in the underside surface of base 44 at the intersection of grooves 46 to provide clearance for a weld bead which may project from the frame at the junction of sections 24 and 28.

There is a slot 56 in support post 22 to which a conventional airless spray gun 58 may be attached to the frame member 20 with means for adjusting the distance desired between the spray gun 58 and the surface to be painted. A spray gun extender 60 may be used to mount the spray gun 58 to the support post 22. The spray gun extender 60 includes a remote trigger that attaches to the spray gun trigger and a handle for moving the cart by hand. Spray gun extender 60 is similar to an Outrigger gun pole, Product No. 757-920, available from Titan Tool, Inc., Oakland, N.J. Spray gun extender 60 generally differs from the Outrigger gun pole in that extender 60 utilizes a shorter two-piece pole and a different fastener adapted for mounting the extender to support post 22. Spray gun extender 60 typically includes a spray gun holder 62, top and bottom pole sections 64 and 66, a control lever 68, and a control cable 70. An adjustable joint 72 having mating grooved faces 77 (see FIG. 12) on the spray gun holder 62 allows a wide range of pivotable adjustments of spray gun 58 about a horizontal axis. Control cable 70 runs from the control lever 68 along or inside the pole sections 64 and 66 to a lever 74 pivotably mounted on the holder 62 for operating the spray gun 58. When the spray gun 58 is mounted in the spray gun holder 62, spray gun trigger 59 engages lever 74. When the control lever 68 is pulled, control cable 70 transfers that movement to lever 74, which in turn pulls the spray gun trigger 59 to begin spraying. Upon release of control lever 68, a return spring 76 allows the paint valve in the spray gun 58 to close, by releasing the trigger 59 of the spray gun 58. A fastener 78 attaches the end of the control cable 70 to the gun mount lever 74.

Figure 8:
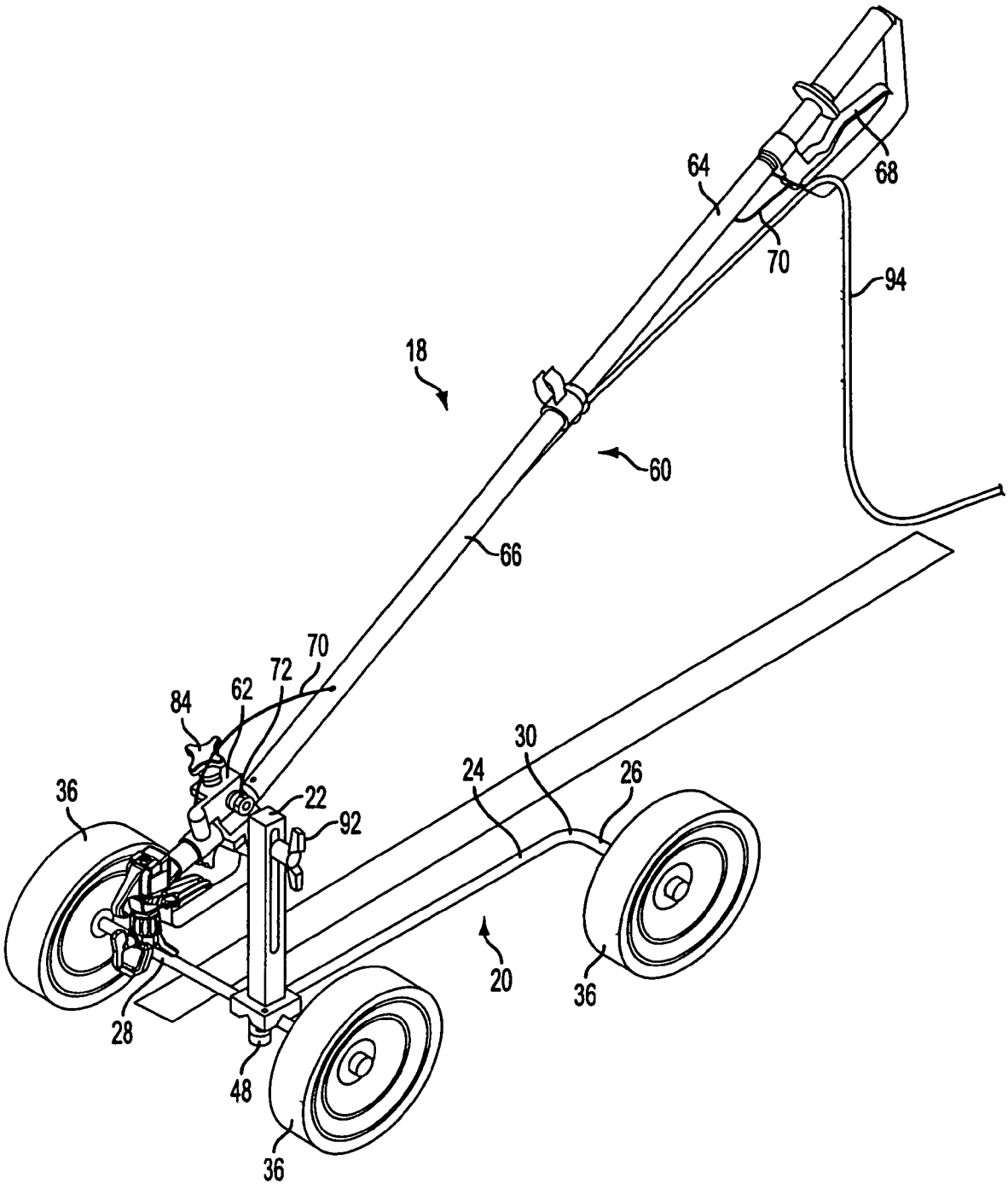
FIG. 8 is a view in perspective of the present invention.
Figure 12:
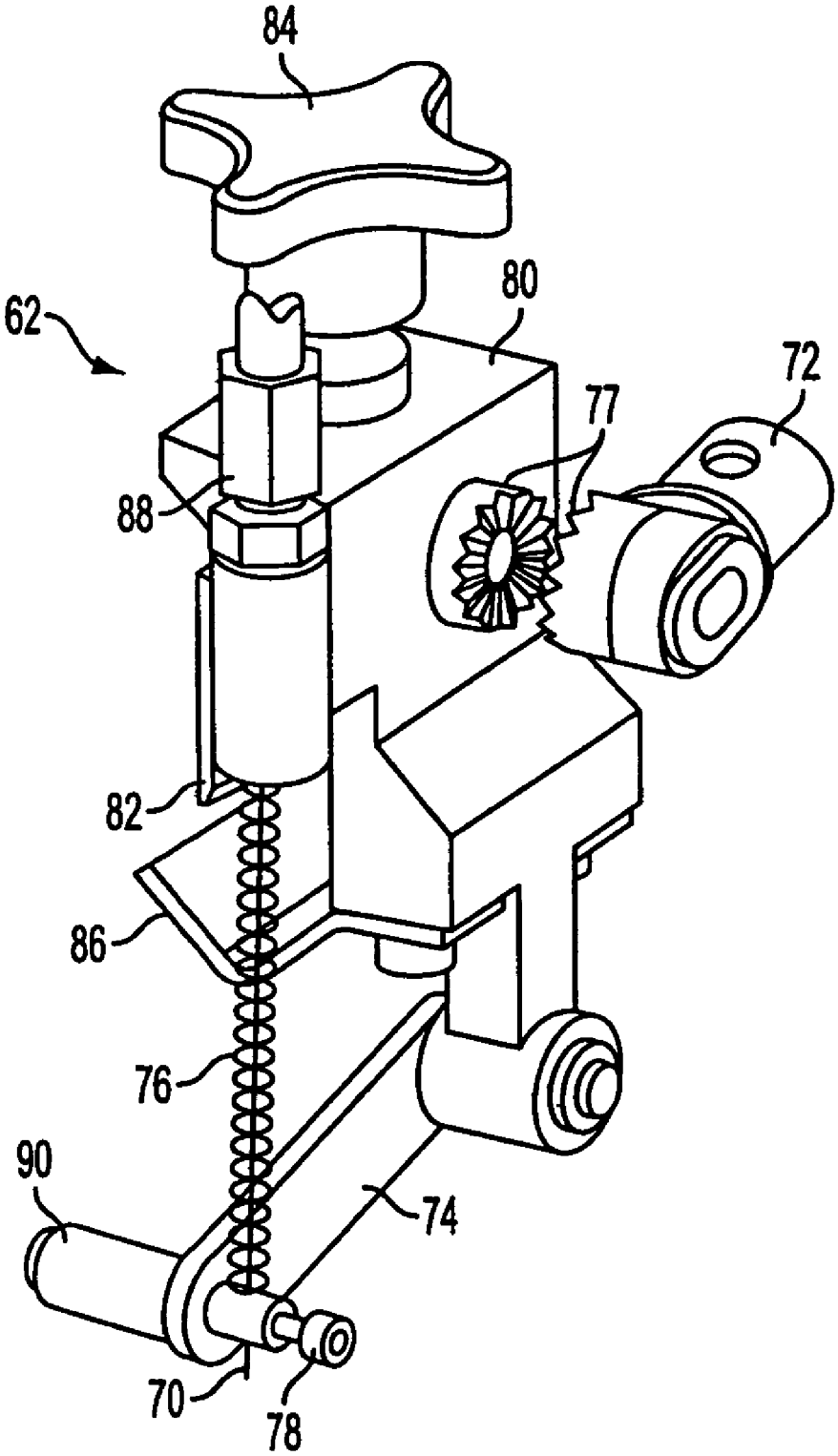
FIG. 12 is a partially exploded view in perspective of a spray gun holder useful in the practice of the present invention.

With reference to FIG. 12, spray gun holder 62 includes a main body 80, a clamping block 82, a clamping knob 84, a gun support bracket 86 and a cable adjuster 88. Initial setup includes placing the spray gun 58 into the gun support bracket 86 so that the spray gun trigger 59 rests on a bushing 90. Knob 84 is then tightened until it comes to rest firmly against a handle of the spray gun 58. The gun holder 62 is then attached to the support post 22 with a winged knob 92 (see FIG. 8). The spray gun position is adjustable by loosening knob 92 and rotating the adjustable joint 72 or moving the gun and gun holder in slot 56 of the support post 22 to the desired position.

It is to be understood that in the practice of the present invention, a pump (also not shown) acting as the external source of paint is located away from and is not mounted on the cart 18. Mounting only the gun 58 and not the pump on the cart maintains the small size and maneuverability of the cart over prior art line stripers having the pump (and necessarily the prime mover for the pump, such as an internal combustion engine or electric motor) located on the cart. A flexible paint hose 94 provides a conduit for transferring paint from an external source (not shown) to the spray gun 58.

In operation, an operator uses the spray gun extender 60 as a handle to manually propel the cart 18 by pushing or pulling in the desired direction and at the same time actuating the control lever 68 to begin spraying a line on the pavement. The operator may use the longitudinal section 24 of the frame member 20 for line-up with a reference marker, such as a chalk line drawn on the surface or an existing line that is to be repainted, when striping long lines.

Figure 2:
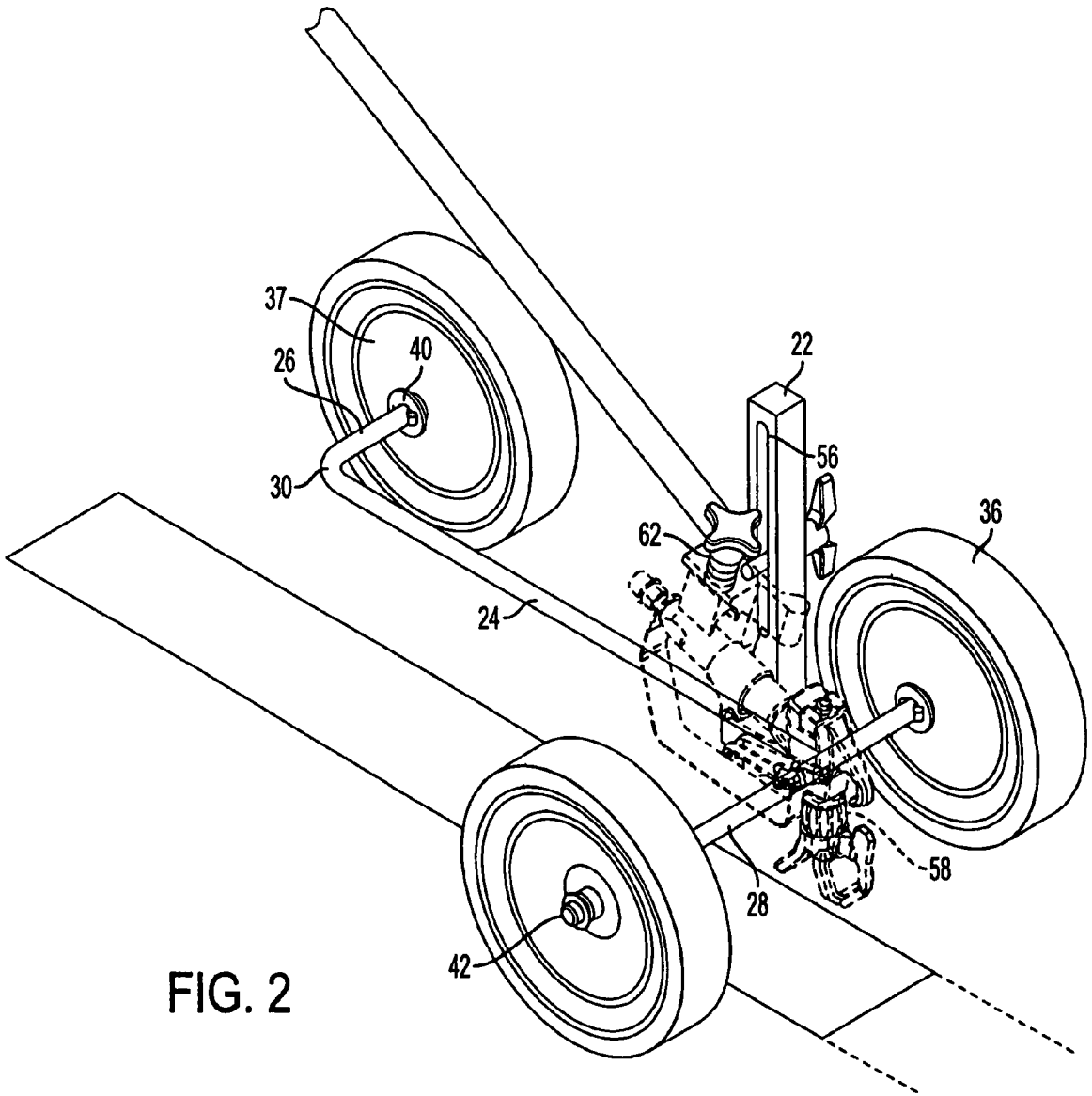
FIG. 2 is a view in perspective showing the present invention generally oriented for use by a right-handed operator.
Figure 3:
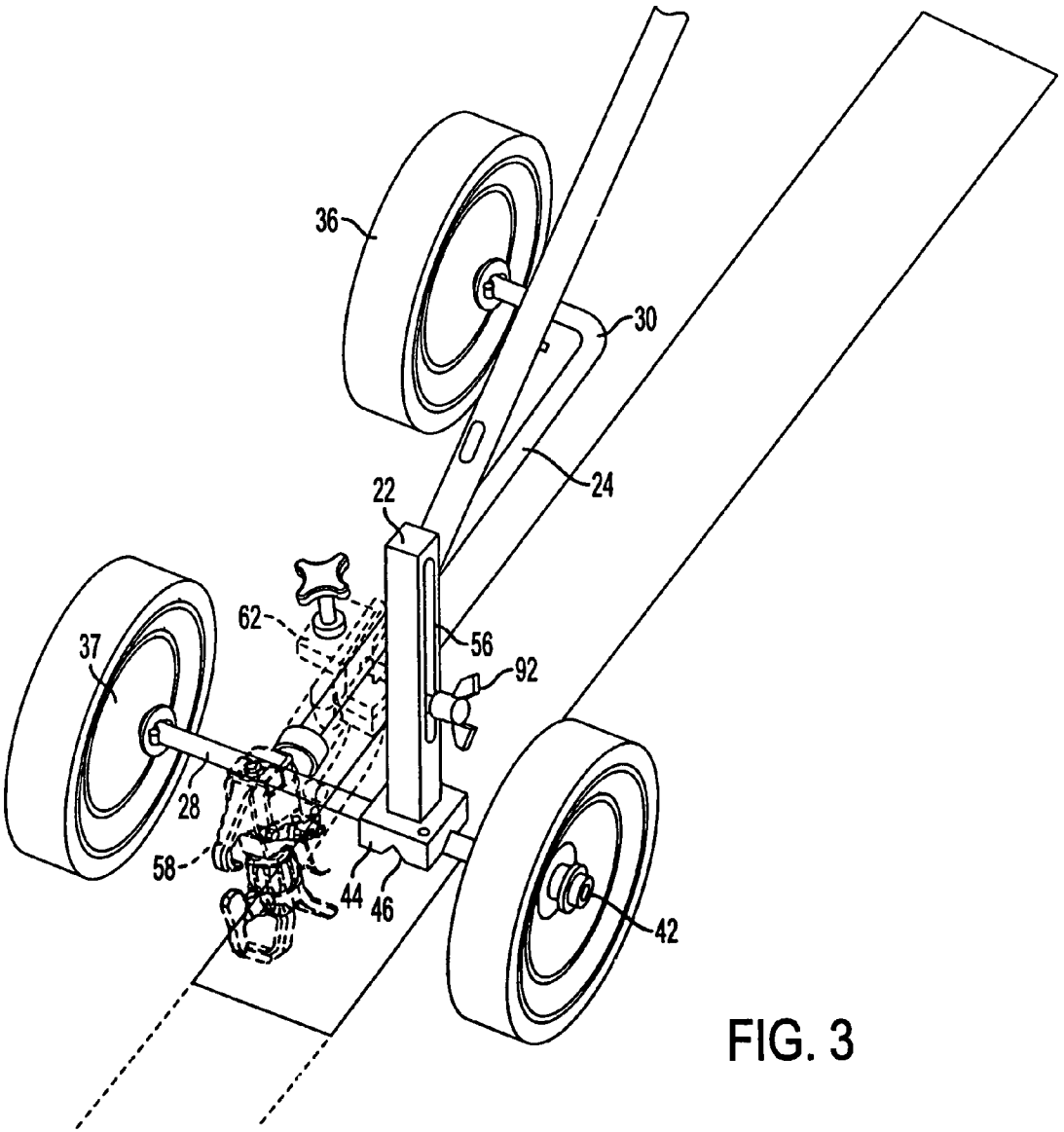
FIG. 3 is a view in perspective showing the present invention generally oriented for use by a left-handed operator.

FIG. 2 shows the present invention in an orientation that is generally preferred by a right-handed operator. FIG. 3 shows a preferred setup for a left-handed operator. This of course is a matter of personal preference and in either case it merely requires flipping the cart over and reattaching the support post 22, spray gun extender 60 and spray gun 58.

Figure 4:
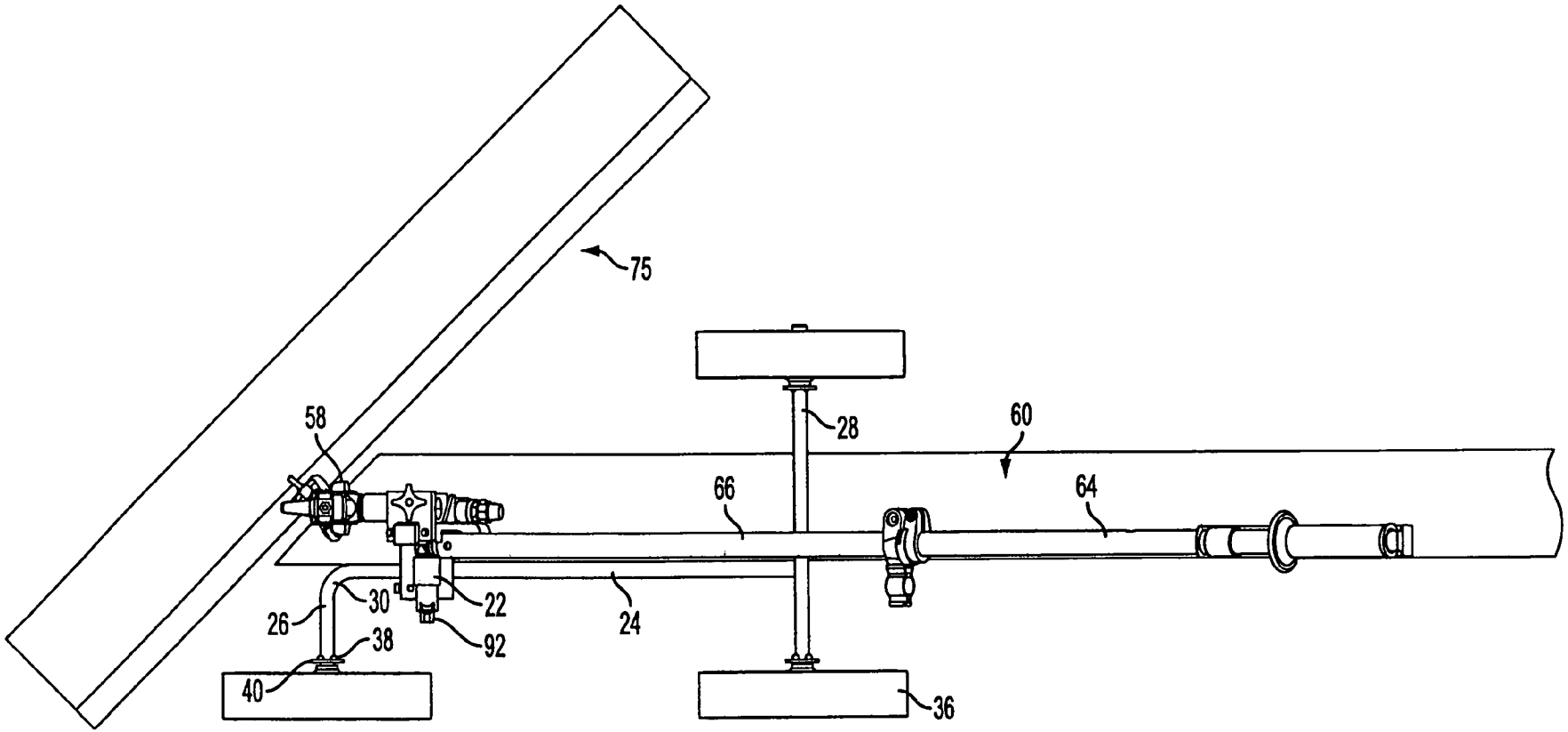
FIG. 4 is an plan view of the present invention showing an orientation suitable for painting crosswalks.

FIG. 4 shows the present invention in an orientation making the unit most suitable for painting angled lines such as in crosswalks. Placing the single wheel in front allows the spray gun to be brought close to a curb 75.

Figure 5:
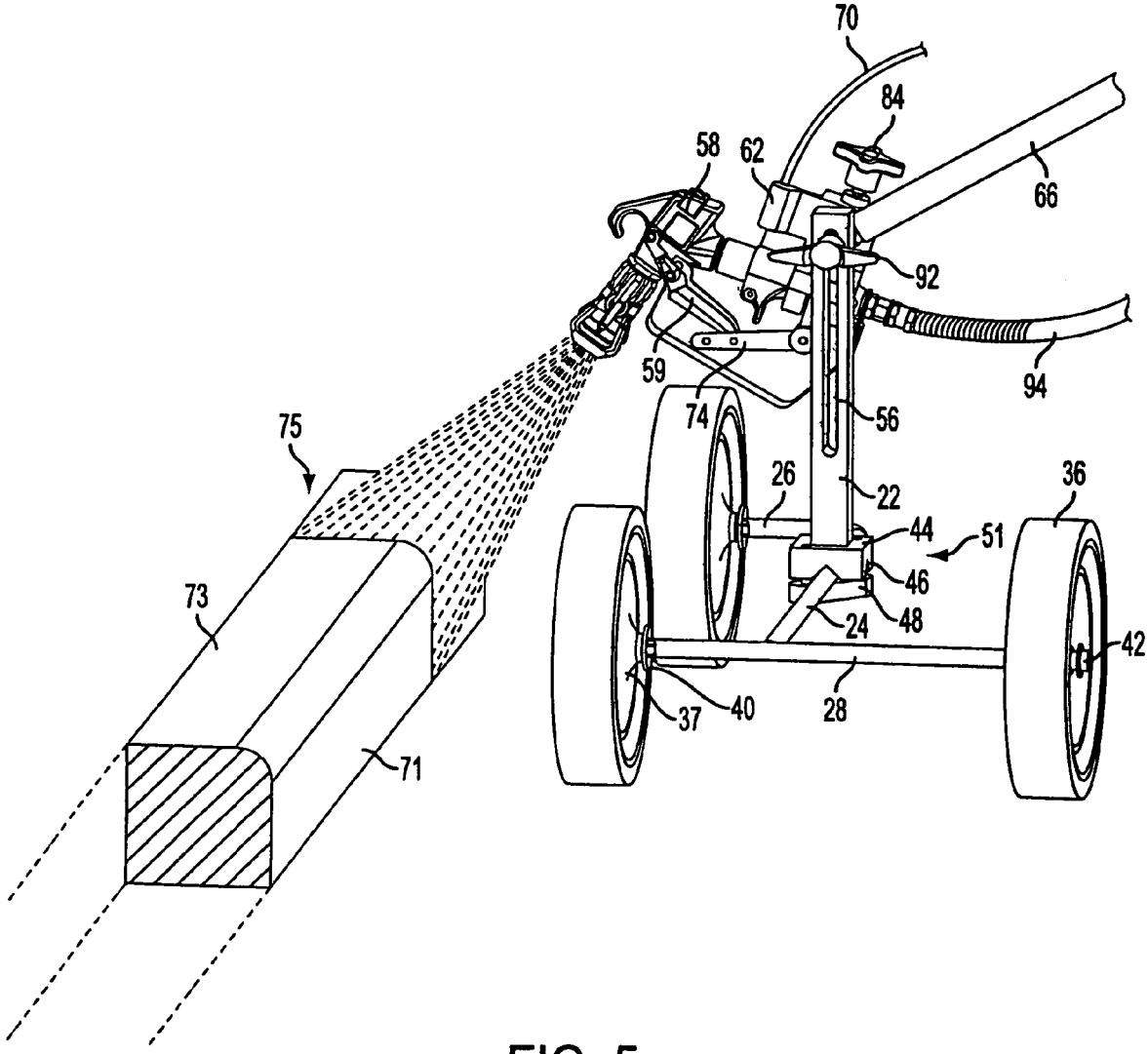
FIG. 5 is a fragmentary view in perspective of the present invention showing an arrangement suitable for painting a curb.

FIG. 5 is another view of the present invention and shows a preferred arrangement for painting a curb. In this orientation, the support post 22 may be rotated ninety degrees, as permitted by the intersecting grooves 46, to a position that places the spray gun 58 perpendicular to the path of travel of cart 18. This allows the operator to face the painted surface directly for better control. Making adjustments like placing the support post 22 at a desired angle with respect to the vertical axis, adjusting the gun holder 62 in slot 56, and setting the adjustable joint 72 as may be necessary will allow the operator to spray both a vertical surface 71 and a horizontal surface 73 of a standard curb 75 at the same time.

Figure 6:
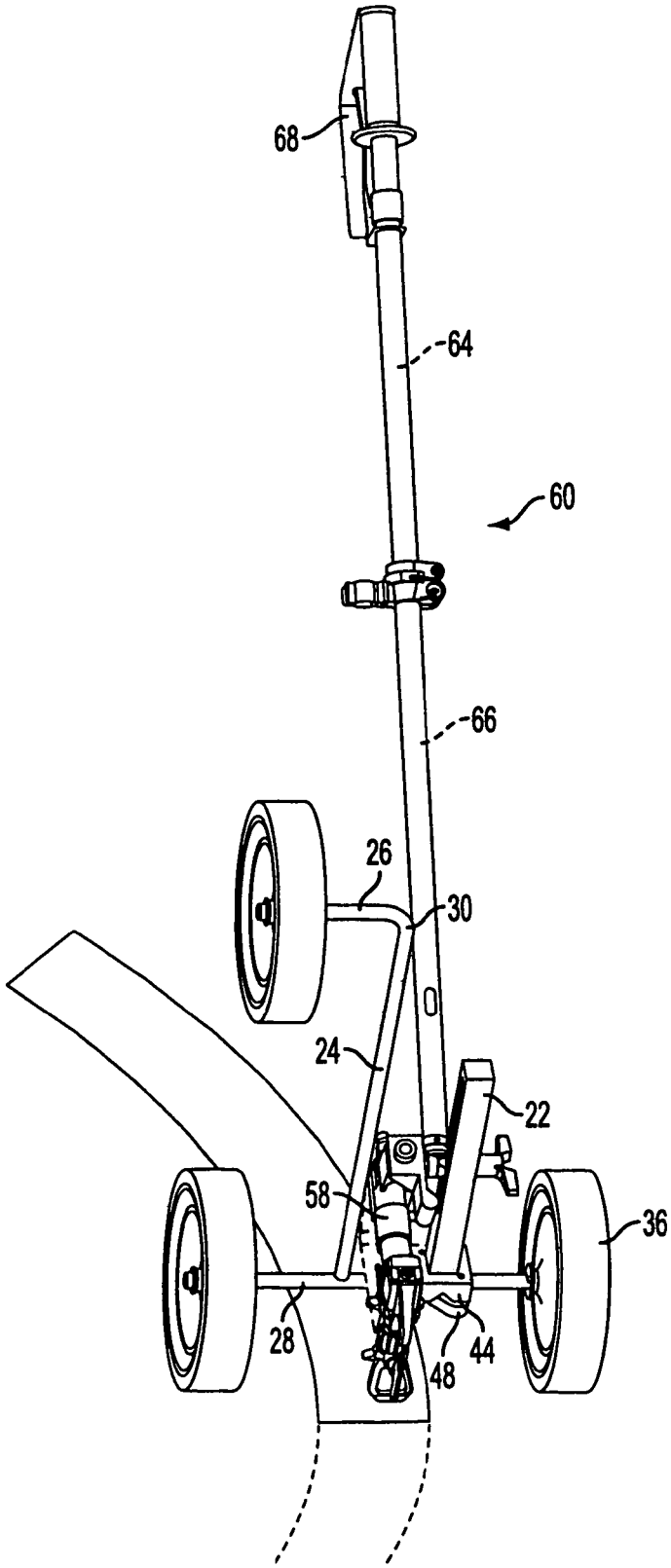
FIG. 6 is a view in perspective of the present invention showing an arrangement suitable for painting curves and circles.
Figure 7:
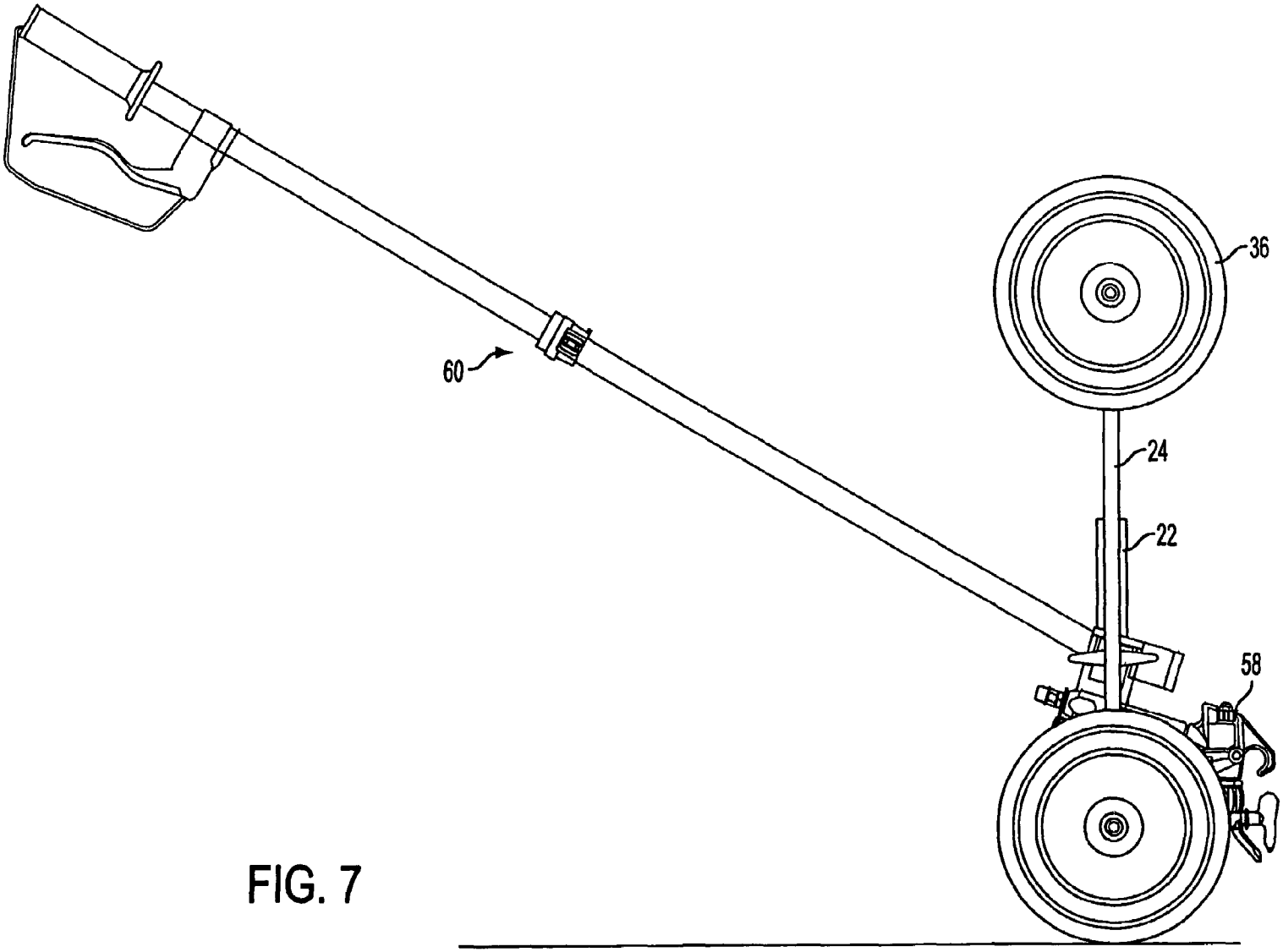
FIG. 7 is an elevation view of the present invention shown in FIG. 6.

FIGS. 6 and 7 show yet another arrangement of the present invention and its versatility wherein it may be converted from a 3-wheel cart to a 2-wheel cart for spraying curved lines and circles. In this configuration, the cart 18 is rotated onto the wheels 36 that are supported by the second transverse section 28 once the support post 22 has been repositioned for this orientation.

Although not shown in the drawings, it will be readily understood that owing to its lightweight construction, the cart can be easily lifted over a line once painted and placed in position to paint another line without the need to back it off the line, or run over the recently painted line with one of the wheels. The handle on pole 64 can also be used to rotate the cart onto the two in-line wheels, thus allowing the cart to be wheeled away from the recently painted line until the free wheel clears it and then the cart may be placed back on the ground.

When it is desired to use the spray gun 58 for other purposes, it can be disengaged from the gun holder 62 for hand spraying.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

We claim:

1. A line striper cart comprising: a) a J-shaped frame member having a longitudinal section with first and second ends, and first and second transverse sections connected to said longitudinal section at the first and second ends thereof, respectively, such that the first and second transverse sections are parallel to each other; b) a plurality of wheels mounted on said frame member, c) means for attaching a spray gun to the cart, said attachment means being adjustably positionable along said frame member, and d) means for moving the cart by hand, wherein the plurality of wheels includes a pair of laterally spaced wheels at one end of said frame member and a single wheel at the other end of said frame member for three-wheeled operation of the cart, and wherein said J-shaped frame member is adjustable such that said single wheel is positionable off the ground relative to the pair of laterally spaced wheels for two-wheeled operation of the cart.

2. The line striper cart of claim 1, wherein said first transverse section is secured at one of its ends to the first end of said longitudinal section and said second transverse section is secured intermediate its ends to the second end of said longitudinal section.

3. The line striper cart of claim 1, wherein the plurality of wheels includes a pair of laterally spaced wheels at one end of said frame member and a single wheel at the other end of said frame member and wherein said single wheel is positioned in-line with one of said laterally spaced wheels.

4. The liner striper cart of claim 1, wherein the means for attaching a spray gun comprises a spray gun holder.

5. The line striper cart of claim 1, characterized by the absence of a pump mounted on the cart.

6. The line striper cart of claim 1, wherein the means for moving the cart by hand comprises a spray gun extender.

7. The line striper cart of claim 6, wherein the spray gun extender further comprises a handle.

8. The line striper cart of claim 1, wherein the transition from three-wheeled operation to two-wheeled operation is effected through a re-positioning of the attachment means.

9. The line striper cart of claim 1, wherein the attachment means is positioned on a transverse section intermediate said pair of laterally spaced wheels during two-wheeled operation of the cart.

10. The line striper cart of claim 1, wherein the attachment means is adjustably positionable on and self-centering relative to the frame member via a clamp member having intersecting v-shaped recesses.

11. The line striper cart of claim 1, wherein the attachment means further comprises a support post having an elongated slot extending along the longitudinal axis of the support post for adjustable attachment of a spray gun to the cart.

12. The line striper cart of claim 11, further comprising a spray gun holder attached to the support post via the elongated slot, said spray gun holder being slidably and angularly repositionable within said elongated slot.

13. The line striper cart of claim 1, wherein said moving means further comprises a length-adjustable pole having a control means for operating a spray gun attached to the cart.

14. The line striper cart of claim 13, wherein said pole further comprises a handle and said control means further comprises a control lever incorporated into said handle.

15. The line striper cart of claim 14, further comprising a spray gun holder attached to said attachment means and a control cable extending between said control lever and said spray gun holder for remote control of said spray gun holder from said handle.

16. A line striping apparatus comprising: a) a frame member generally having a J-shape, said frame member including a longitudinal section, a first transverse section forming a right angle to said longitudinal section at a first end thereof, and a second transverse section forming a right angle to said longitudinal at a second end thereof, b) a plurality of wheels rotatably mounted on said frame member, c) means for adjustably mounting a spray gun on said frame member, said mounting means being selectively positionable along the length of said frame member; c) means for supplying paint to said spray gun; and d) means for moving said frame member by hand, wherein the plurality of wheels includes a pair of laterally spaced wheels at one end of said frame member and a single wheel at the other end of said frame member for three-wheeled operation of the line striping apparatus, and wherein said frame member is adjustable such that said single wheel is positionable off the ground relative to the pair of laterally spaced wheels for two-wheeled operation of the line striping apparatus.

17. The line striping apparatus of claim 16, wherein the plurality of wheels includes a pair of laterally spaced wheels at one end of said frame member and a single wheel at the other end of said frame member and wherein said single wheel is positioned in-line with one of said laterally spaced wheels.

18. The line striping apparatus of claim 16, wherein the means for moving the frame member by hand comprises a spray gun extender.

19. The line striping apparatus of claim 18, wherein the spray gun extender further comprises a handle.

20. The line striping apparatus of claim 16, wherein the transition from three-wheeled operation to two-wheeled operation is effected through a re-positioning of the mounting means.

21. The line striping apparatus of claim 16, wherein the mounting means is positioned on a transverse section intermediate said pair of laterally spaced wheels during two-wheeled operation of the line striping apparatus.

22. The line striping apparatus of claim 16, wherein the mounting means is adjustably positionable on and self-centering relative to the frame member via a clamp member having intersecting v-shaped recesses.

23. The line striping apparatus of claim 16, wherein the mounting means further comprises a support post having an elongated slot extending along the longitudinal axis of the support post for adjustable attachment of a spray gun to the line striping apparatus.

24. The line striping apparatus of claim 16, further comprising a spray gun holder attached to the support post via the elongated slot, said spray gun holder being slidably and angularly repositionable within said elongated slot.

25. The line striping apparatus of claim 16, wherein said moving means further comprises a length-adjustable pole having a control means for operating a spray gun attached to the line striping apparatus.

26. The line striping apparatus of claim 25, wherein said pole further comprises a handle and said control means further comprises a control lever incorporated into said handle.

27. The line striping apparatus of claim 26, further comprising a spray gun holder attached to said attachment means and a control cable extending between said control lever and said spray gun holder for remote control of said spray gun holder from said handle.

28. The line striping apparatus of claim 16, wherein the supplying means further comprises a flexible hose attachable between a paint supply and said spray gun holder.

* * * * *